US006075192A

United States Patent [19]

Hoshino

[11] Patent Number: 6,075,192

[45] Date of Patent: Jun. 13, 2000

[54] CONNECTION FOR THE OPERATING ROD OF A HIGH HAT STAND

[75] Inventor: Yoshihiro Hoshino, Nagoya, Japan

[73] Assignee: Hoshino Gakki Co., Ltd., Japan

[21] Appl. No.: 09/178,227

[22] Filed: Oct. 23, 1998

[30] Foreign Application Priority Data

Feb. 24, 1998 [JP] Japan ..... 10-060584

[51] Int. Cl.[7] ..... G10D 13/02

[52] U.S. Cl. ..... 84/422.3; 84/422.1

[58] Field of Search ..... 84/422.1–422.4

[56] References Cited

U.S. PATENT DOCUMENTS

| | | | |
|---|---|---|---|
| 5,388,495 | 2/1995 | Atsumi | 84/422.3 |
| 5,415,072 | 5/1995 | Huang | 84/422.3 |
| 5,990,401 | 11/1999 | Braun et al. | 84/422.1 |
| 5,994,635 | 11/1999 | Hoshino | 84/422.1 |

*Primary Examiner*—Jeffrey Donels

*Attorney, Agent, or Firm*—Ostrolenk, Faber, Gerb & Soffen, LLP

[57] ABSTRACT

A connecting rod, particularly useful as the rod for supporting a cymbal of a high hat stand. The connecting rod has first and second parts with respective externally screw threaded regions toward each other to be coupled. A connecting nut is internally screw threaded to receive both of the screw threaded ends of the rod parts. The end of the bore in the connecting nut which is toward the first rod part is conically tapered. A compression nut is externally conically tapered and received in the conical portion of the bore of the connecting nut. The first rod part is received in the compression nut, where it is compressed, and is also screwed into the internal screw thread of the narrowed end of the compression nut. A lock nut on the threaded portion of the second rod part is tightened against that end of the connecting nut away from the tapered bore. The first rod part is compressed as the nuts are tightened.

6 Claims, 8 Drawing Sheets

CONNECTION FOR THE OPERATING ROD OF A HIGH HAT STAND

BACKGROUND OF THE INVENTION

This invention relates to a correction between parts of a rod, particularly useful for; high hat stand and particularly a connection between parts of the operating rod of the high hat stand.

PRIOR ART EMBODIMENT

In FIGS. 7–9, a prior art high hat stand H1 is shown. It is played when an upper movable cymbal 52 is moved up and down by an operating rod 70 through operation of a foot pedal 64, and moves against a lower fixed cymbal 51 arranged at the top of the stand, for banging cymbals together or separating them.

An upper pipe 53 accommodates the top part of the operating rod 70. A lower pipe 54 holds the upper pipe 53. An installation part 55 fixes the lower fixed cymbal 51 to the upper pipe. Another installation part 56 fixes the upper movable cymbal 52 to the operating rod 70. The installation part 56 has a tightening bolt 56*b*.

An installation part 57 fixes the upper pipe 53 and the lower pipe 54. The installation part 57 has a tightening bolt 57*b*. A memory lock 58 sets the height of the upper pipe 53. Stand legs 59 and 60 are held by the holding members 61 and 62 to the lower pipe 54. A support frame 63 supports the lower pipe 54. An operating member 65, such as a chain, is arranged between the foot pedal 64 and the operating rod 70.

A spring 66 continuously biases the operating rod 70 upward. A stopper 67 fixes the upper end of the spring 66 to the operating rod 70. A spring lower end holding member 68 holds the lower end of the spring 66. An engaging bar 69 is provided integrally with the spring lower end holding member 68.

In this kind of high hat stand H1, the operating rod 70 is usually divided into an upper rod 71 and a lower rod 75, as shown in FIG. 8. They are freely removably joined by a connecting nut 80. The connection between the upper rod 71 and the lower rod 75 is effected by screwing the outside screw parts 72 and 76 at the lower part of the upper rod 71 and at the top part of the lower rod 75 into the inner screw 81 of the connecting nut 80. An upper lock nut 85 is screwed to the top of the connecting nut 80 for securely positioning the connecting nut 80 with respect to the operating rod 70 and for preventing the operating rod 70 and the connecting nut 80 from becoming shaky.

In addition, a lower lock nut 86 is screwed to the bottom of the connecting nut 80. If the upper lock nut 85 is not used, the lengths of the outside screw part 72 of the operating rod 70 and the inside screw part 81 of the connecting nut 80 are increased.

When the high hat stand H1 is to be transported or to be stored away, it is often divided into two parts, the upper side H1*a* and the lower side H1*b*, as shown in FIG. 9. The high hat stand H1 is separated in the following manner.

The lower fixed cymbal 51 and the upper movable cymbal 52 are taken out of the upper pipe 53 and the upper rod 71, respectively. The upper pipe 53 is extracted from the lower pipe 54. The upper lock nut 85 is loosened and the upper rod 71 is then loosened from the connecting nut 80 for separating the operating rod 70. During this separation, the lower lock nut 86 normally remains fixed to the lower rod 75. The high hat stand is assembled by reversing the above dividing operation.

The conventional high hat stand H1 described above, however, has a problem. If the locking of the connecting nut 80 by the upper lock nut 85, that has been loosened at the time of disassembling, is weak, the upper rod 71 and the connecting nut 80 become shaky during a performance, and the up and down movement of the operating rod 70 or the stepping operation of the foot pedal 64 produce noise.

In addition, a hexagonal nut is often used as the upper lock nut 85 and as the lower lock nut 86. This prevents the nut 85 from contacting the inner wall of the upper pipe 53 during up and down movement inside the upper pipe 53 along with the operating rod 70. Therefore, a tool, such as a wrench, etc. is required for tightening or loosening the upper lock nut 85, for assembling or disassembling the high hat stand H1 or for joining or separating the operating rod 70.

However, a performer rarely carries around tools like a wrench, etc. at all times. Even if he may have a wrench on hand, it is troublesome to use one. He may simply use his hand to loosen the upper lock nut 85 during assembly of a high hat stand H1 that has been divided. In such a case, the upper lock nut 85 is loosened, and it assumes an idle state, during the course of performance. At the same time, the upper lock nut 85 also may be in an idle state with respect to the outer screw part 72 of the upper rod 71. Therefore, due to the weakness of the locking of the connecting nut 80 by the upper lock nut 85, the upper rod 71 and the connecting nut 80 become shaky, which may produce noise during a performance.

During disassembly of the high hat stand H1 or when operating rod 70 is being separated, the upper lock nut 85 that has been loosened easily remains idle in a free state. It may drop from the upper rod 71 and be ultimately lost.

When the lengths of the externally threaded screw part 72 of the operating rod 70 and the internally screw threaded part 81 of the connecting nut 80 are increased without using the lock nut 85 described above, the screwing of the operating rod 70 in the connecting nut 80 (or of the connecting nut 80 on the operating rod 70) or the unscrewing of the operating rod 70 with respect to the connecting nut 80 (or the connecting nut 80 with respect to the operating rod 70) requires time and effort, making it difficult to assemble or disassemble the high hat stand H1 in a short time.

SUMMARY OF THE INVENTION

This invention has the object of solving the aforementioned problems. The invention provides an operating rod connecting part of a high hat stand which is capable of preventing the operating rod and the connecting nut from becoming shaky, preventing noise generation during a performance, preventing the possible loss of parts at disassembly, and carrying out assembly and disassembly simply and in a short period of time, without requiring a tool such as a wrench, etc.

The invention relates to the connecting part of the operating rod in a high hat stand, wherein the operating rod is moved up and down by operation of a foot pedal and the operating rod is installed on an upper movable cymbal the connecting part supports the upper movable cymbal for movement with respect to the lower fixed cymbal or for separating them. The operating rod is divided into an upper rod and a lower rod, which are freely separable and connected by a connecting nut. The invention comprises a connecting nut having an internally screw threaded part, having a lower half that is screwed onto the upper externally screw threaded part of the lower rod member and an upper half that is screwed onto the lower externally screw threaded part of the upper rod. A conical inner tapered surface is formed at the top opening part. A lower lock nut has an inner screw part which is screwed onto the upper outside screw part of the lower rod. The top part contacts the lower end of the connecting nut. An upper nut has a compressive insertion part which inserts the axial part of the rod. An inner screw part is screwed onto the lower outside screw part of the upper rod at the lower part of the compressive insertion part, with a conical outer tapered surface that fits into the inner tapered surface of the connecting nut.

In addition, the invention relates to the connecting part of the operating rod in the high hat stand where a screwless inner tubular part is formed between the inner screw part of the connecting nut and the inside tapered surface.

Other objects and features of the invention are explained below with reference to the attached drawings.

DESCRIPTION OF A PREFERRED EMBODIMENT

Figure 1:
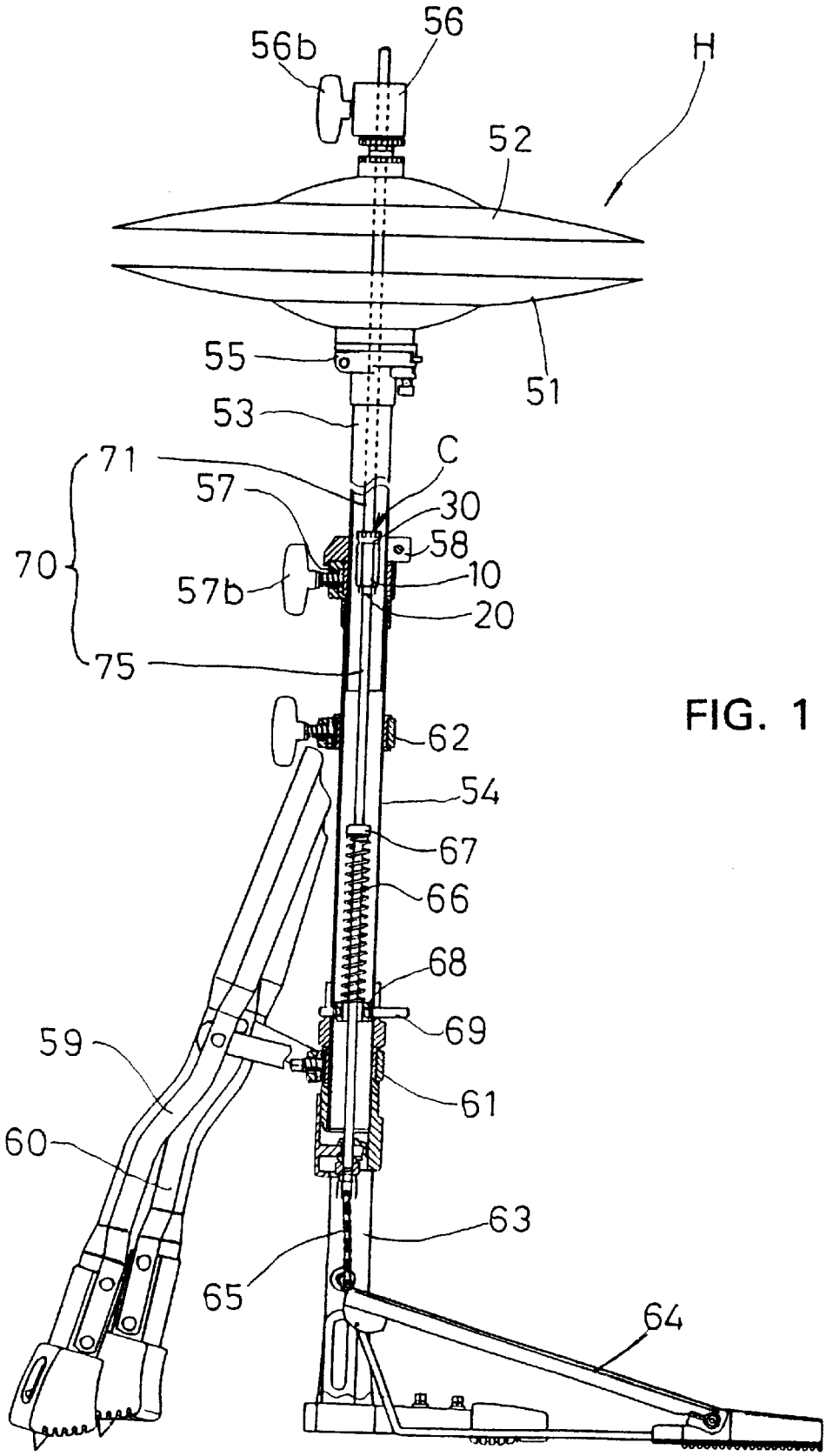
FIG. 1 is a partially cross sectional side view of an example of the high hat stand according to the invention.
Figure 7:
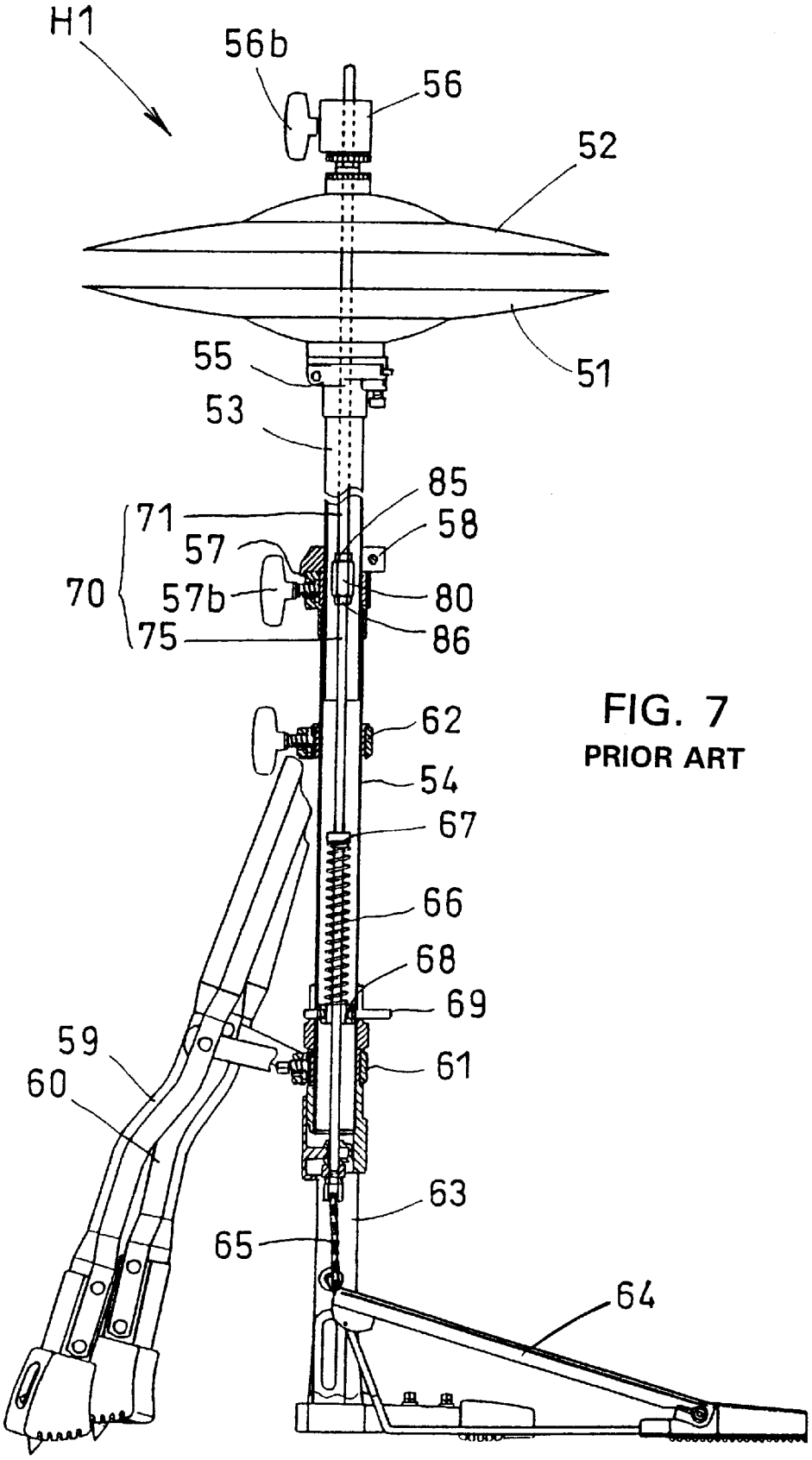
FIG. 7 PRIOR ART
FIG. 7 is a side view of an example of a high hat stand according to prior art.
Figure 8:
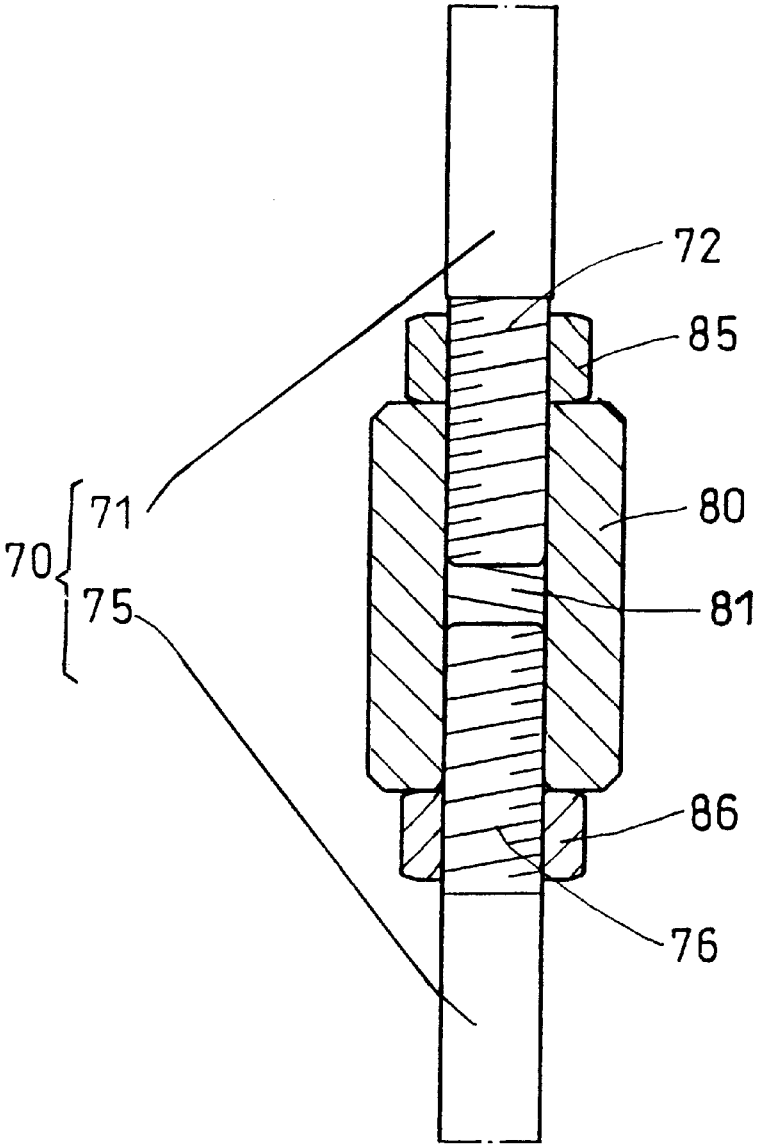
FIG. 8 PRIOR ART
FIG. 8 is an expanded cross section of its essential part of the prior art stand.
Figure 9:
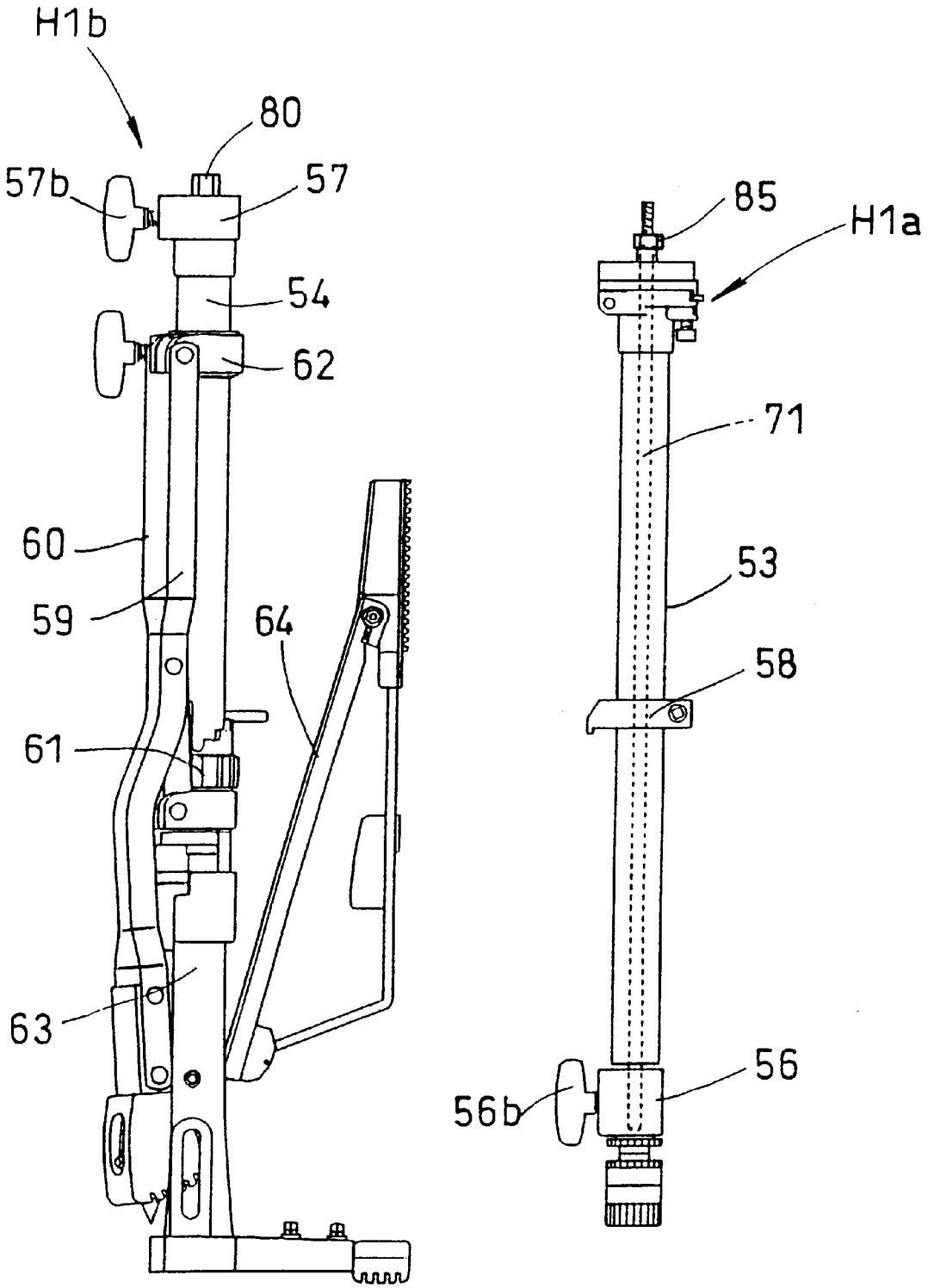
FIG. 9 PRIOR ART
FIG. 9 is a side view showing the divided state of the prior art high hat stand.

The high hat stand H shown in FIG. 1 has the same structure as the high hat stand H1 in FIGS. 7 through 9 except for the structure of the connecting part C in the operating rod 70. The same reference numbers are used.

In the high hat stand H, an operating rod 70 installed on the upper movable cymbal 52 is moved up and down by operation of the foot pedal 64 to bang the upper cymbal on the lower fixed cymbal 51. The rod 70 is divided into the upper rod 71 and the lower rod 75 which are freely separably joined by the connecting nut 10.

The connecting part C of the operating rod 70 comprises a connecting nut 10, a lower lock nut 20 and an upper nut 30.

Figure 2:
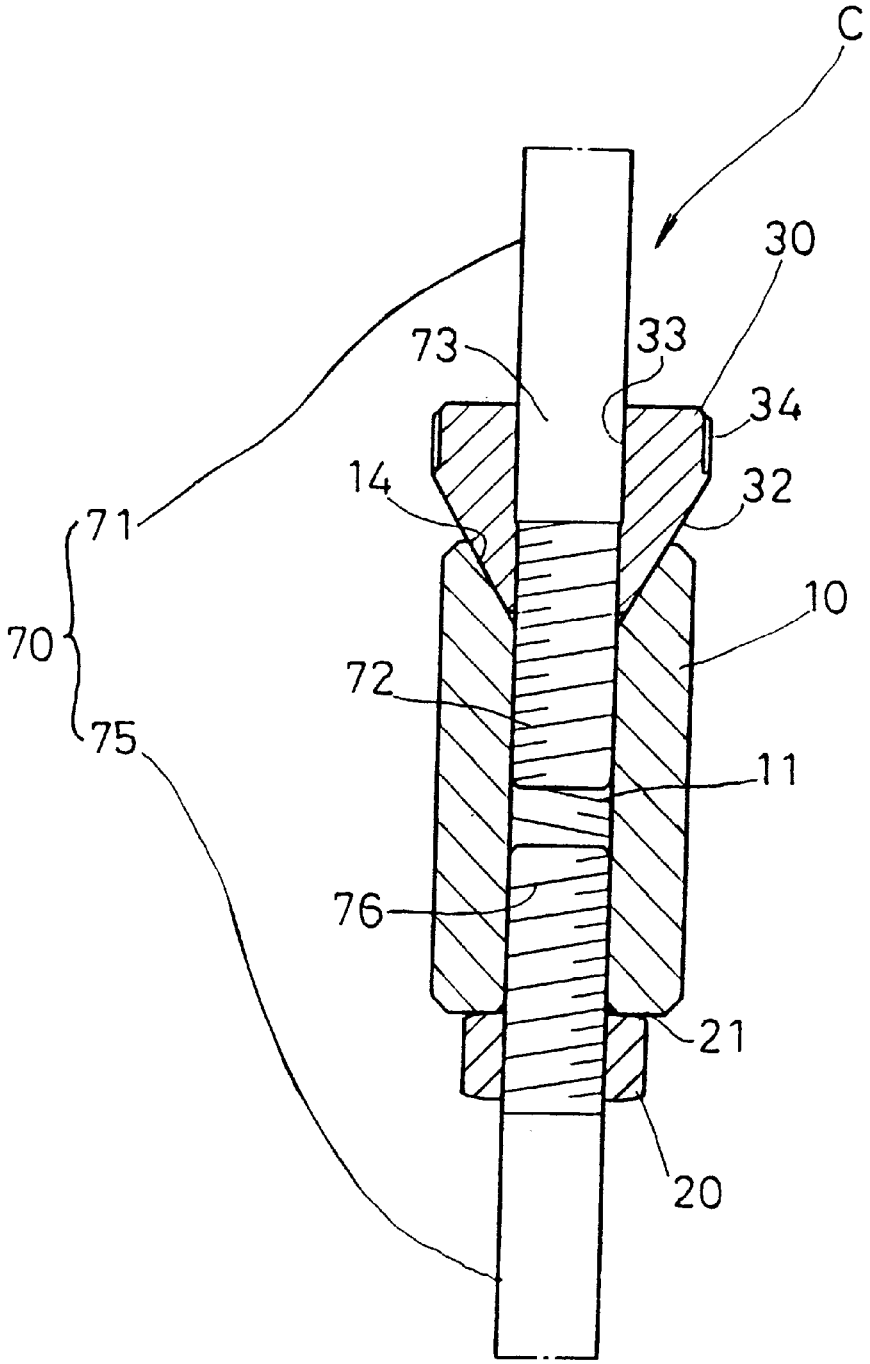
FIG. 2 is an expanded cross section of the essential part.
Figure 3:
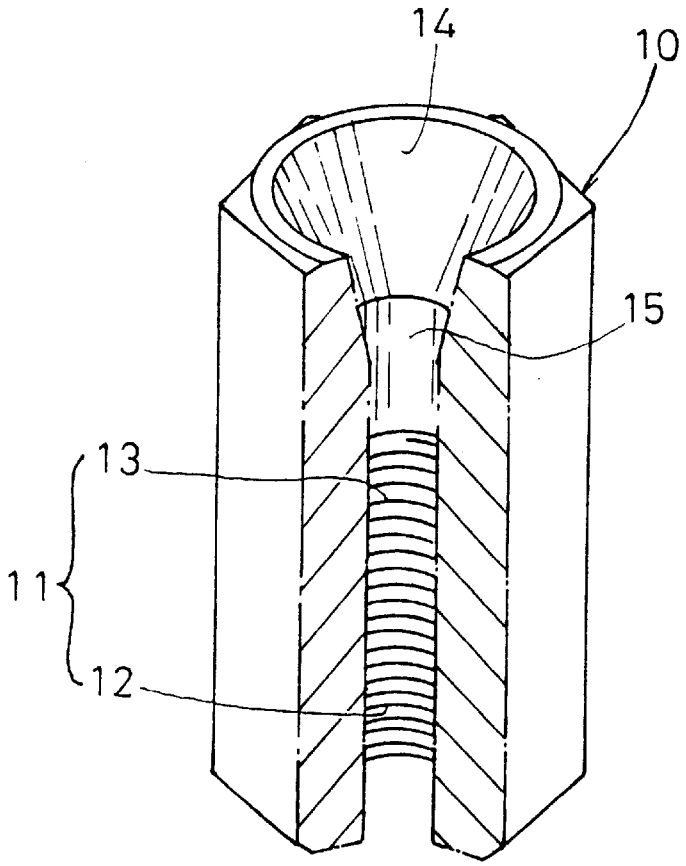
FIG. 3 is an oblique view showing the connecting nut of the high hat stand.

As is shown in FIGS. 2 and 3, the connecting nut 10 is internally screw threaded at 11 with a lower half 12 that is screwed onto the upper externally screw threaded part 76 of the lower rod 75 and an upper half 13 that is screwed onto the lower externally screw threaded part 72 of the upper rod 71. The nut 10 also has a conical shape internally tapered surface 14 formed at the upper opening.

A screw thread free inner tubular part 15 is formed between the internally screw threaded part 11 and the internally tapered surface 14. As the inner tubular part 15 is formed in this manner, it is sufficient for the lower externally screw threaded part 72 of the upper rod 71 to be only screwed in approximately 50 percent when the lower externally screw threaded part 72 of the upper rod 71 is screwed into the internally screw threaded part 11 of the connecting nut 10.

Moreover, prior to screwing the upper rod 71 into the connecting nut 10 or prior to screwing the lower externally screw threaded part 72 of the upper rod 71 into the internally screw threaded part 11 of the connecting nut 10, both of the screw threaded parts 72 and 11 are coaxially aligned to some degree, enabling the screwing in to be carried out smoothly. Accordingly, assembly of the high hat stand H can be carried out easily and speedily.

The lower lock nut 20 has an internally screw threaded part to be screwed onto the upper externally screw threaded part 76 of the lower rod 75, with the upper part 21 of the nut 20 contacting the lower end of the connecting nut 10. A hexagonal nut is used, as in the above described conventional example, as the lower lock nut 20.

Figure 4:
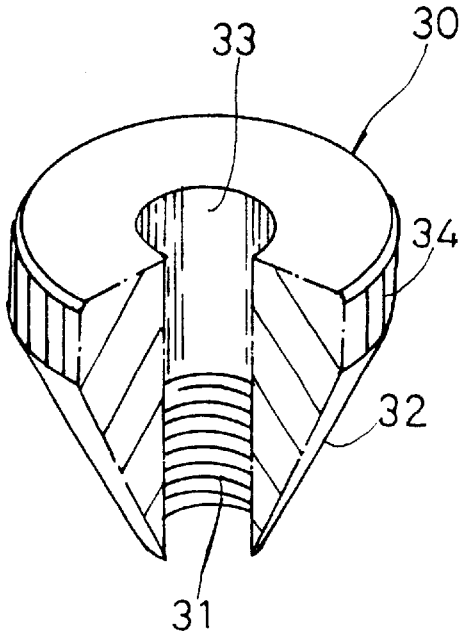
FIG. 4 is an oblique view showing the upper nut of the high hat stand.

As is shown in FIGS. 2 and 4, the upper nut 30 has a compressive insertion opening 33 which compressively receives the axial lower part 73 of the upper rod 71 and has an internally screw threaded part 31 which is screwed onto the lower externally screw threaded part 72 of the upper rod 71 at the bottom of the compressive insertion opening 33. This forms a conical shape outside tapered surface 32 of the nut 30 that fits the inner tapered surface 14 of the connecting nut 10.

The upper nut 30 is desirably comprised of synthetic resin and it is integrally installed on the axial lower part 73 of the upper rod 71 by the compressive insertion opening 33. This integrally fixes the upper nut 30 to the upper rod 71, thereby firmly joining them to the connecting nut 10 under the load applied on the upper rod 71.

When the high hat stand H is to be disassembled or when the operating rod 70 is to be separated, moreover, this arrangement prevents the upper nut 30 from being idle and dropping from the upper rod 71 as it then may be ultimately lost.

Moreover, a knurled surface 34 is formed on the top peripheral surface of the upper nut 30 to facilitate rotary operation of the upper nut 30 and the upper rod 71 that have become integrated.

The tapered surface 14 on the connecting nut 10 and the outside tapered surface 32 on the upper nut 30, that are to be joined together at the time of assembly, holds the upper rod 71 at two locations on the connecting nut 10. The lower externally screw threaded part 72 of the upper rod 71 is screwed into and is held in the internally screw threaded part 11 of the connecting nut 10, while the externally tapered surface 32 of the upper nut 30 that has been screwed onto the upper rod 71 is held together with the inner tapered surface 14 of the connecting nut 10. This strengthens the union between the upper rod 71 and the connecting nut 10, thereby making it possible to prevent both of them from becoming shaky during a performance and making it possible to prevent noise from being generated during the performance.

Figure 5:
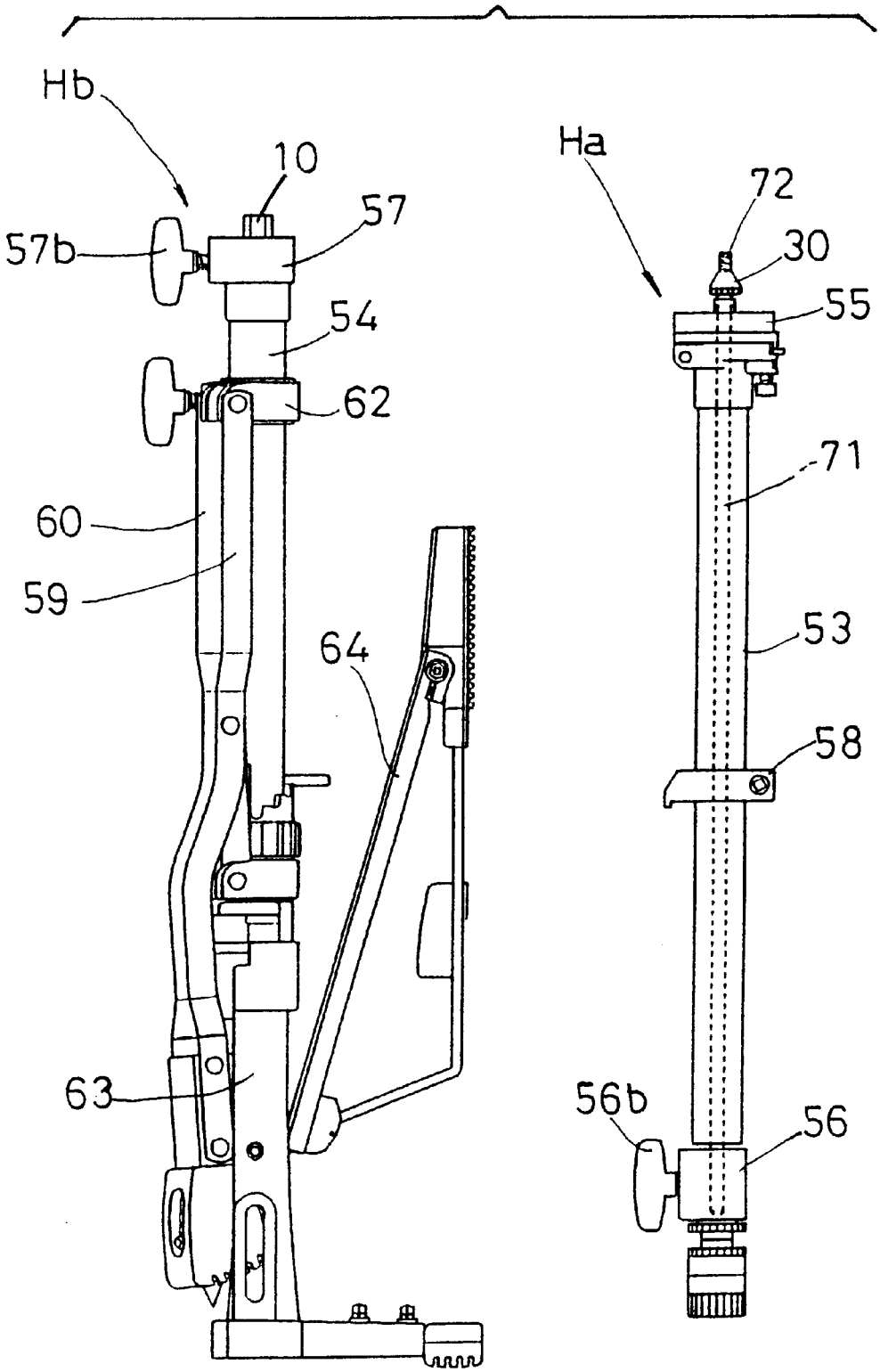
FIG. 5 is a side view showing the divided condition of the high hat stand.

The high hat stand may be divided in two sections, the upper side Ha and the lower side Hb, when it is to be transported or stored, as shown in FIG. 5. This division of the high hat stand H may be the same as shown above for the high hat stand H1, except for the method of separating the operating rod 70. Therefore, only the method of separating the operating rod 70 is explained.

Figure 6:
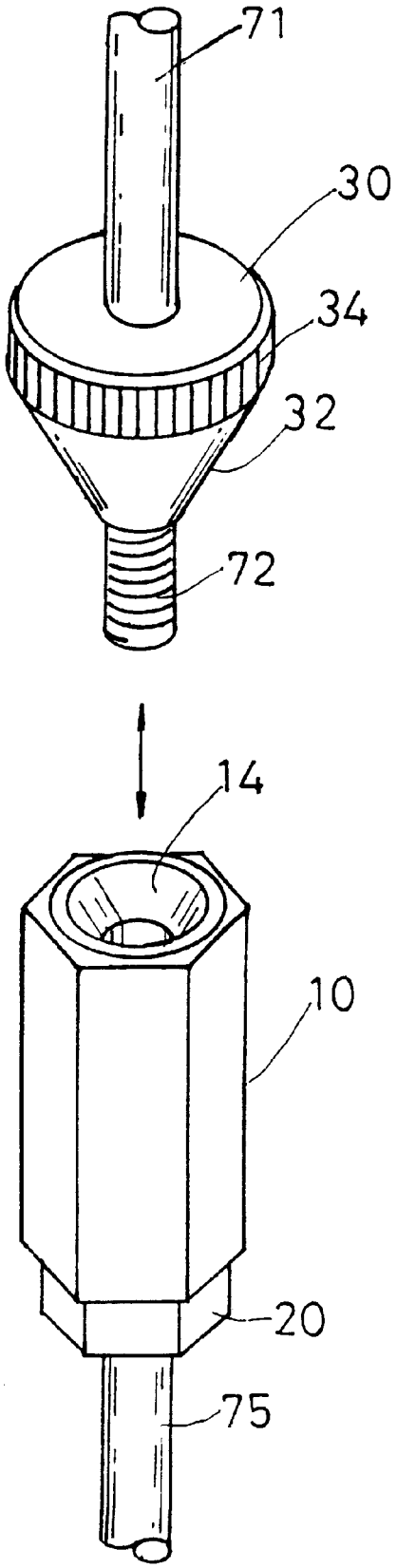
FIG. 6 is an expanded oblique view of the essential part.

The operating rod 70 in the high hat stand H can be separated by merely hand loosening the upper rod 71, to which the upper nut 30 has been integrally fixed, by rotating the rod part 71 and then withdrawing them together from the connecting nut 10, as shown in FIG. 6. This makes it possible to separate the operating rod 70 in a simple and speedy fashion. It is not necessary to separately loosen the upper lock nut and the connecting nut, as in the conventional stand. In addition, there is no need to use tools, such as a wrench, etc.

Furthermore, it is advisable to insert the upper rod 71 of the upper part Ha in a direction which is opposite to the direction for assembly of the rod 70 after the division of the high hat stand H, as in FIG. 5, or to insert the rod 71 into the upper pipe 53 in such a way that the upper nut 30 that has been screwed to the bottom end of the upper rod 71 may be situated outside the installation part 55 of the upper pipe 53 for the lower fixed cymbal, to fix the other terminal part of the upper rod 71 that has protruded from the upper pipe 53 (the opposite side terminal of the upper nut 30) with the tightening bolt 56*b* of the upper movable cymbal installation part 56 and thereby accommodate and hold the upper rod 71 in the upper pipe 53.

As the upper rod 71 is protected by the upper pipe 53, this prevents the upper rod 71 being bent or damaged as it contacts other objects and due to the vibrations stemming from its transportation, etc.

The installation part 56 for the lower fixed cymbal has an outside diameter that is larger than the opening of the upper pipe 53 and the upper nut 30, which has an outside diameter that is larger than the upper rod insertion opening of the installation part 55 for the upper fixed cymbal. These are fixed at both ends of the upper rod 71 that has been accommodated and held in the upper pipe 53. This prevents the upper rod 71 from becoming idle or slipping away from the upper pipe 53.

Joining the operating rod 70 at the time of assembly of the high hat stand H can be done simply and speedily and, also firmly without requiring a tool, like a wrench, etc. by manually inserting the upper rod 71 where the upper nut 30 has been integrally fixed into the connecting nut 10.

As described above, the connecting nut 10 and the upper nut 30 have tapered surfaces 14 and 32 formed thereon. This makes it easier to properly position the upper rod 71 at the time when it is to be screwed into the connecting nut 10.

The connective part of the operating rod in the high hat stand has an upper rod and a connecting nut which are firmly fixed by the screw and at two locations on the tapered surface. This makes it possible to prevent the operating rod and the connecting nut from becoming shaky and prevents noise from being generated during a performance. At the same time, the upper nut is constructed integrally with the upper rod. Therefore, there is no reason why the upper nut should be lost. Thus, it is possible to both assemble and disassemble simply and speedily without using a tool like a wrench, etc.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A connection between first and second parts of a rod, the connection comprising:

the first rod part having a first externally screw threaded end region toward the second rod part and the second rod part having a second externally screw threaded end region toward the first rod part;

a connecting nut having a third end toward the first rod part and a fourth end toward the second rod part, the connecting nut having a first bore therein in from the ends of the connecting nut, the bore having a fifth internally threaded region toward its third end for receiving the first region screwed therein and having a sixth internally threaded region toward its fourth end for receiving the second region screwed therein; a conically tapering surface in the first bore in from the third end and narrowing toward the fifth region; and a compression nut with a second bore for receiving the first end region of the first rod part, the second bore having a part which compresses the first rod part in the compression nut, the second bore also having an internally screw threaded seventh region for receiving the first region and the compression nut having an external surface that is tapered to be received in and compressed by the conically tapering surface in the first bore.

2. The connection of claim 1, further comprising a lock nut with an internally threaded bore for receiving the second region and for being tightened against the fourth end of the connecting nut.

3. The connection of claim 2, wherein the compression nut second bore has an eighth region that is furthest from the wide end thereof and that is internally threaded and has a ninth region closest to the wide end which is without a thread and the first region of the first rod part being received in the ninth region of the compression nut.

4. The connection of claim 3, wherein the tapering surface in the first bore and the external surface of the compression nut are not threaded surfaces.

5. The connection of claim 1, wherein the compression nut second bore has an eighth region that is furthest from the wide end thereof and that is internally threaded and has a ninth region closest to the wide end which is without a thread and the first region of the first rod part being received in the ninth region of the compression nut.

6. The connection of claim 1, wherein the tapering surface in the first bore and the external surface of the compression nut are not threaded surfaces.

* * * * *